United States Patent [19]

Hartman

[11] Patent Number: 4,726,115

[45] Date of Patent: Feb. 23, 1988

[54] MANUFACTURE OF LOW PROFILE CLIP CONNECTOR

[75] Inventor: John Hartman, Painesville, Ohio

[73] Assignee: Minnesota Mining and Manufacturing Company, St. Paul, Minn.

[21] Appl. No.: 816,415

[22] Filed: Jan. 6, 1986

[51] Int. Cl.[4] ..... H01R 43/01

[52] U.S. Cl. ..... 29/858; 264/263; 264/273; 264/277

[58] Field of Search ..... 29/857–859, 29/848, 849; 264/272.15, 275, 273, 277, 263, 279.1; 339/17 CF, 218 R, 218 CM

[56] References Cited

U.S. PATENT DOCUMENTS

| | | | |
|---|---|---|---|
| 2,700,206 | 1/1955 | Gilbert | 264/263 |
| 2,701,867 | 2/1955 | Obenschain et al. | 339/218 M |
| 3,274,533 | 9/1966 | Apted et al. | 339/218 M |
| 3,277,426 | 10/1966 | Klostermann | 339/218 M |
| 3,307,139 | 2/1967 | Prise | 339/176 MF |
| 3,851,294 | 11/1974 | Palazzetti et al. | 339/176 MF |
| 4,030,799 | 6/1977 | Venaleck | 339/99 |
| 4,038,359 | 7/1977 | Pendleton | 264/273 |
| 4,294,789 | 10/1981 | Lincoln et al. | 264/273 |
| 4,547,028 | 10/1985 | Morgan et al. | 339/17 CF |

FOREIGN PATENT DOCUMENTS 1910241 9/1970 Fed. Rep. of Germany ... 339/218 R

*Primary Examiner*—P. W. Echols

*Attorney, Agent, or Firm*—Renner, Otto, Boisselle & Lyon

[57] ABSTRACT

A method of manufacturing an electrical clip-like connector of low profile including an electrical cable having plural insulated electrical conductors, and at least one connector body including therein plural electrical contacts having contacting portions for engaging respective leads of an electrical device and coupling portions electrically connected to respective conductors of the cable, comprising the steps of simultaneously urging the coupling portions of the contacts into mechanical and electrical engagement with respective conductors of the cable to form electrical junctions therebetween, using a premolded insert of electrically non-conductive material placed within a cavity of a mold in supporting engagement with the mold to support the contacts in proper position in relation to the mold cavity, and after having closed the mold, flowing molten plastic material into the mold cavity to form the balance of the connector body about at least a portion of each of the contacts, cable, electrical junctions and insert to form an integral structure with the insert forming a part of the connector body.

19 Claims, 11 Drawing Figures

MANUFACTURE OF LOW PROFILE CLIP CONNECTOR

The invention herein disclosed relates generally to the manufacture of electrical connectors and, more particularly, to the manufacture of a low profile clip connector attachable, for example, to an integrated circuit (IC) package for connecting the conductors of an electrical cable to the leads of such IC package.

BACKGROUND AND RELATED APPLICATIONS

In Morgan et al copending U.S. Patent Application Ser. No. 539,121, now U.S. Pat. No. 4,547,028, there is disclosed an electrical clip-like connector of low profile that is attachable to an electrical device such as an integrated circuit package for connecting the conductors of an electrical cable with the leads of such device. Because of its low profile, the connector may be used in situ in confined environments. The connector comprises an electrical cable of the flat or ribbon type including plural electrical conductors and a pair of low height clip bodies molded to the cable. Each clip body includes therein plural electrical contacts each having an exposed contacting portion for engaging a respective lead of the electrical device and a mounting portion about which the clip body is molded and which is electrically connected to a respective conductor of the cable at a portion thereof from which the cable insulation has been removed. The connector also comprises a connecting mechanism for mechanically connecting the pair of bodies with respect to each other for mounting of the connector to the electrical device with respective electrical contacts engaged with respective leads of the device. Such connecting mechanism may include parallel leaf springs at respective lateral ends of the connector and to which the clip bodies are also molded.

Manufacture of such low profile connector was accomplished by first soldering the contacts to respective conductors of the cable at portions of the conductors from which the cable insulation had been removed to form a cable/contact sub-assembly. The sub-assembly was then placed along with the leaf springs into the cavity of a mold for molding of the clip bodies about respective portions of the cable, portions of the leaf springs, and portions of the contacts with the soldered junctions being fully encapsulated by the clip bodies to provide a hermetic seal about the soldered junctions. After the mold was closed, molten plastic material from which the clip bodies were formed was introduced into the mold cavity to fill the same, this involving flow of the molten plastic material around the cable to provide clip body portions both above and below the cable.

In such prior manufacturing procedure, there was a problem of cable shifting when the plastic clip bodies were molded around the cable. That is, forced flow of molten plastic material engaging a planar surface of the cable in the mold cavity would tend to shift or displace the cable from its desired intermediate spaced position between top and bottom surfaces of the mold cavity. Consequently, the cable would not be located properly in the molded clip bodies and this cable shifting problem necessitated the scrapping of a considerable number of the connectors which added to the overall cost of manufacturing the connectors.

The cable shifting problem was solved in copending U.S. Patent Application Ser. No. 681,362 by the use of separately molded plastic caps which became integral parts of respective clip bodies upon subsequent molding of respective balance forming portions of the clip bodies to the electrical cable. Each cap was in the form of a planar strip of plastic or other suitable material provided with plural tapered holes spaced along its length. The cap was loaded into the test clip mold along with the cable/contact sub-assembly with the cap in juxtaposition with the side of the cable opposite the contacts. After the mold was closed, molten plastic material was introduced into the mold cavity to form the balance of the clip body, the molten material flowing up through an insulation removed area of the cable around the soldered junctions and into the tapered holes of the cap which locked the cap to the thusly molded balance forming portion of the clip body. In operation, the cap formed what may be called an essentially rigid backstop for the cable which prevented shifting of the cable as the molten plastic was forced into the mold cavity. The cap also became an integral part of the clip body forming the upper center portion of the clip body while the subsequently molded balance forming body portion formed the lower and end portions of the clip body. Through elimination of the cable shifting problem, there was provided a clip-like connector of greater uniformity, there being assurance that the cable was properly located in each clip body, i.e., the electrically non-conductive support portion of the connector.

Clip connectors of the foregoing low profile type have been used for high speed signal testing purposes which often require the use of high speed signal transmission line cable. In such cable, the signal conductors were bounded by ground conductors for signal isolation purposes and provision was made in the connectors for connecting the ground isolation conductors to ground potential at the connector/cable interface.

Such clip connectors also have been or can be used for purposes other than testing, such as signal injecting, signal reading, device connection or the like. By way of specific example, such clip connectors have been used to connect an add-on fixed disc drive to a closed architecture microcomputer. For this purpose, the connecting cable leading from the drive's controller would be provided with a clip connector which was attachable directly to the computer's microprocessor for connecting the conductors of the cable to the leads of the microprocessor. Although the connecting cable heretofore utilized in this application was of the high speed signal transmission line type, a cable without ground isolation could be used with satisfactory results, such as flat PVC cable including only signal conductors.

The signal conductors of flat cable could be connected to the connector's contacts by soldered junctions and the soldered junctions sealed by the clip bodies molded thereabout in the above-indicated manner. The soldering procedure, however, is relatively difficult to perform in relation to the insulation displacement technique heretofore used to connect simultaneously each of plural conductors of a cable to respective contacts in other types of electrical connectors. Typically, these other types of electrical connectors include multiple housing parts between which the cable is clamped, and usually before or during clamping the plural contacts of the connector puncture the electrical insulation of the cable to connect with respective conductors of the cable. An example of a low profile, insulation displacement connector which is clip-like attachable to an integrated circuit package is shown in U.S. Pat. No.

4,190,311, but such connector has inadequate protection against the problems associated with moisture and oxygen at the electrical junctions, e.g., corrosion and oxidation which degrade connector performance. The latter problems were previously addressed in Venaleck U.S. Pat. No. 4,030,799, but the connector illustrated in this patent was not designed for clip-like attachment to an electrical device such as an integrated circuit package. Although it would be desirable to use an insulation displacement or similar technique to effect electrical connections in a low profile clip connector of the general type shown in the above-noted copending patent applications, the cable type permitting, and also to mold the clip bodies about the thusly formed electrical junctions, such heretofore has not been attempted or accomplished.

SUMMARY OF THE INVENTION

The present invention provides a method of manufacturing an electrical connector including an electrical cable having plural insulated electrical conductors, and at least one connector body including therein plural electrical contacts having contacting portions for engaging respective leads of an electrical device and coupling portions electrically connected to respective conductors of the cable. Briefly, the method comprises the steps of (a) simultaneously urging the coupling portions of the contacts into mechanical and electrical engagement with respective conductors of the cable to form electrical junctions therebetween; (b) using a premolded insert of electrically non-conductive material placed within a cavity of a mold in supporting engagement with the mold to support the contacts in proper position in relation to the mold cavity; and (c) after having closed the mold, flowing molten plastic material into the mold cavity to mold the balance of the connector body about at least a portion of each of the contacts, cable, electrical junctions and insert to form an integral structure with the insert forming a part of the connector body.

More particularly, the insert is placed in a first mold part which forms the mold cavity with a second mold part. After placement of the insert, the cable is positioned between the second mold part and the coupling portions of the contacts supported on the insert, each coupling portion including a pair of terminal arms defining a conductor-receiving slot therebetween with which respective conductors of the cable are aligned. The first and second mold parts then are relatively moved towards one another with the second mold part engaging the cable at its side opposite the contacts simultaneously to urge the cable conductors between and into engagement with the terminal arms of respective contacts. The cable preferably is a flat multi-conductor type, and the insulation of the cable may be removed from portions of the conductors to facilitate insertion of such portions between the terminal arms during closing of the first and second mold parts. If desired, insulation need not be removed from the conductors in which case the terminal arms of the contacts may be generally pointed to pierce through the insulation of the cable to permit passage of the cable conductors between the terminal arms of respective contacts.

According to another aspect of the invention, there is provided a method of manufacturing an electrical clip-like connector including an electrical cable having plural insulated conductors, a pair of connector bodies molded to respective portions of the cable, each connector body including therein plural contacts having contacting portions for engaging respective leads of an electrical device and coupling portions electrically connected to respective conductors of the cable, and at least one resilient connecting member which connects the bodies for relative pivotal-like movement to permit clip-like attachment of the connector to the electrical device. Such method comprises the steps of (a) simultaneously urging the coupling portions of the contacts for each body into mechanical and electrical engagement with respective conductors of the cable to form electrical junctions therebetween which are longitudinally spaced along the cable from the electrical junctions formed between conductors and the contacts for the other body; (b) using a pair of premolded inserts of non-conductive material placed within respective body forming cavities of a mold in supporting engagement with the mold to support the contacts for respective bodies in proper position with respect to the body forming cavities; (c) positioning the resilient connecting member in the mold with opposite ends thereof extending into respective body forming cavities; and (d) after closing the mold, flowing plastic material into each cavity to mold the respective body about at least a portion of each of the contacts, cable, electrical junctions, insert and connecting member to form an integral structure with each insert forming a part of the respective connector body.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Reference to vertical and horizontal, top and bottom, upper and lower, etc., are used herein for convenience in description and not by way of limiting the clip connector to a specific orientation inasmuch as the specific orientation thereof will be dependent on the particular application made of the clip connector.

Figure 1:
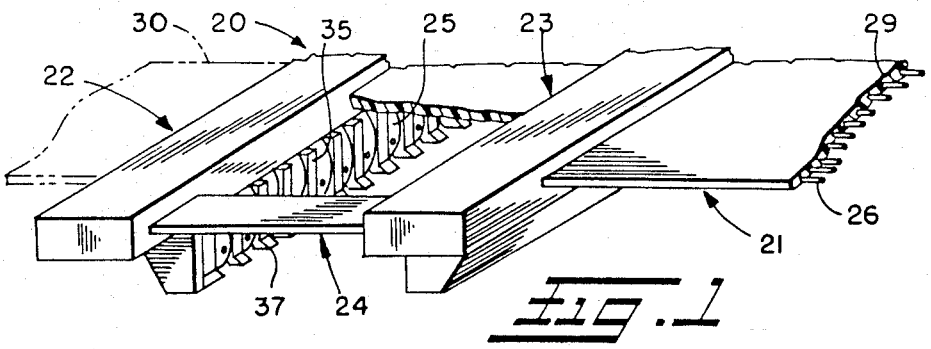
FIG. 1 is a partial isometric view, partly broken away in section, of a low profile clip connector according to the invention.
Figure 2:
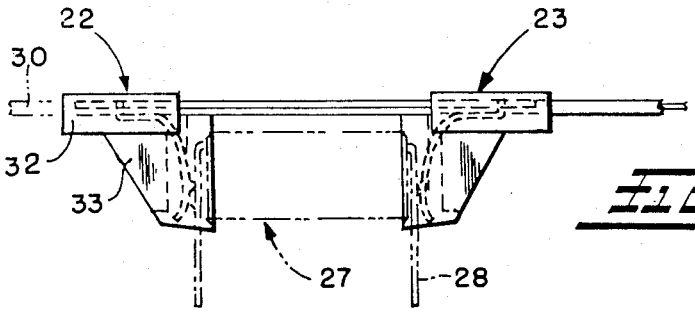
FIG. 2 is a side elevational view of the clip connector of FIG. 1.
Figure 3:
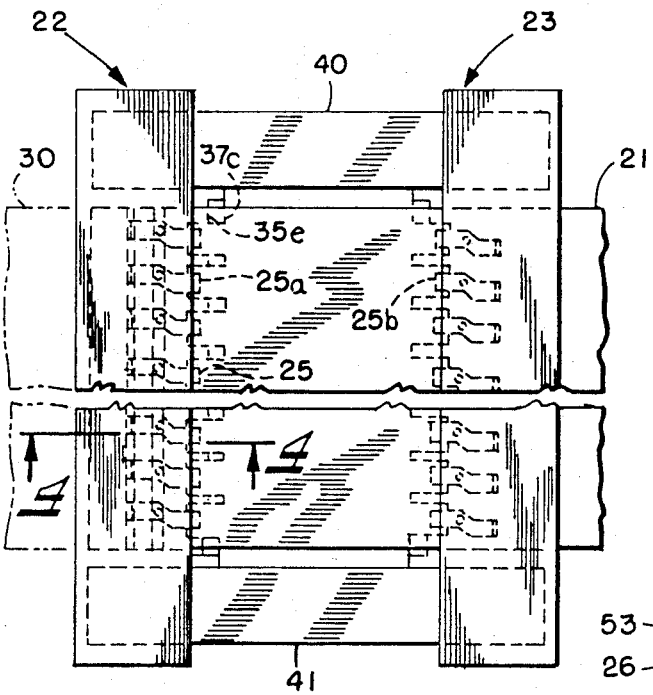
FIG. 3 is a top plan view of the connector of FIG. 1.

Referring now in detail to the drawing and initially to FIGS. 1–3, a low profile clip connector manufactured in accordance with the invention is indicated generally at 20. The clip connector 20 includes an electrical cable 21 and a pair of clip bodies 22 and 23 joined to the cable at longitudinally spaced apart locations and to each other by a connecting mechanism 24. Each clip body 22, 23 includes therein a plurality of electrically conductive contacts 25. The contacts 25 preferably are so closely packed that connections thereof to conductors 26 of the cable 21 will not require any spreading of the cable conductors while on the other hand such contacts still will fit properly and conveniently onto an integrated circuit package 27 or the like to engage electrically the respective leads 28 of such integrated circuit package. The conductors 26 of the cable 21, which may be a flat PVC cable, are electrically isolated and held in generally parallel relation by the insulation 29 of the cable. The connector may be located at the end of the cable as shown or at a portion of the cable intermediate the ends thereof as illustrated by the phantom line extension of the cable at the left in FIGS. 1–3. The phantom line extension 30 may have another connector formed thereon to provide, for example, a parallel bus or daisy chain type connector/cable device.

The clip bodies 22 and 23 preferably are identical but oppositely facing in relation to the longitudinal extent of the cable 21. Accordingly, only the clip body 22 will be described in detail, such description, however, being equally applicable to the other clip body 23.

The clip body 22 generally has an upper body portion 32 joined to the cable 21 and a depending lower body portion 33. The lower body portion 33 at its inner side, i.e., its side nearest the integrated circuit package 27, includes a plurality of finger or wall-like separators 35 which function to separate contacting portions 36 (see FIG. 4) of respective adjacent contacts 25, to protect the contacting portions 36 from damage, to guide the clip body into proper position with respect to the row of leads 28 of an integrated circuit package 27, and to hold the clip connector on such package in cooperation with the other clip body 23 and the connecting mechanism 24. For such purposes, and especially the latter two, jaw-like teeth 37 protrude from the bottom of each separator 35 to provide a gripping function with respect to the integrated circuit package as in the manner illustrated in FIG. 2. The separators 35*e* and teeth 37*e* at respective lateral ends of the group thereof, i.e., the separators and teeth most proximate the lateral ends of the clip body, preferably are wider in lateral direction than are the other separators and teeth therebetween, such width being too great for insertion between a pair of leads of the integrated circuit package to prevent the test clip from being positioned in what might otherwise feel and even visually appear to be a proper position but actually is a mis-aligned position with respect to such leads. The other or intermediate separators and feet are of a narrower width so as to fit into the space between adjacent leads of the integrated circuit package. For further desirable attributes of the clip body in general, reference may be had to above-mentioned copending U.S. patent application Ser. No. 539,121, now U.S Pat. No. 4,547,028 and to copending Morgan U.S. patent application Ser. No. 643,237, now U.S. Pat. No. 4,639,058 filed Aug. 22, 1984 and entitled "Improved Low Profile Test Clip and Handle Therefor".

U.S. Pat. No. 4,547,028 may also be referred to for particulars of the connecting mechanism 24 (therein referred to as a coupling mechanism) which enables relative pivoting of the clip bodies 22 and 23 for installing the clip connector onto the integrated circuit package 27. It, however, is noted here that the connecting mechanism 24 may be comprised of two pairs of leaf springs, such pairs being respectively indicated at 40 and 41 in FIG. 3. The leaf springs of each pair are stacked and located at respective lateral ends of the clip connector. As in the manner shown in copending application Serial No. 539,121, the leaf springs 40 and 41 preferably are provided with openings at opposite ends thereof to enable material of the clip bodies to be molded therethrough to anchor the ends of the springs in the clip bodies. As is preferred, the leaf springs of the connecting mechanism are in or approximately in the plane of the cable 21, such contributing to the low profile of the clip connector for use in confined environments.

Figure 4:
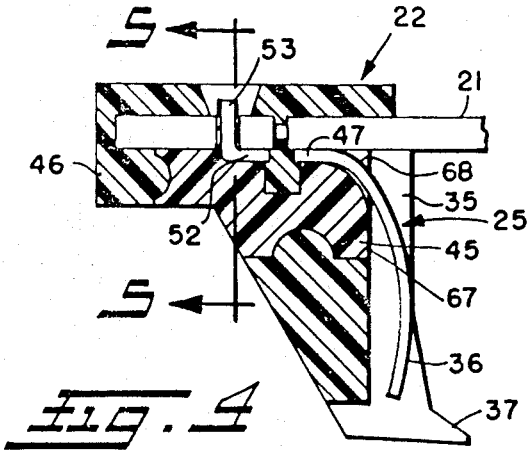
FIG. 4 is an enlarged partial sectional view through one clip body of the clip connector of FIG. 1 taken substantially along the line 4—4 of FIG. 3.

With additional reference to FIG. 4, the clip body 22 includes an insert 45 and a balance forming molded body portion 46 which are both formed of electrically non-conductive material but separately molded. As described, the insert 45 and balance forming body portion 46 may be molded from the same or different electrically non-conductive plastic or plastic-like materials. The balance forming body portion 46 is directly molded in the hereinafter described manner to a mounting portion 47 of each contact 25, part of the leaf springs 40 and 41 as above indicated, part of the cable 21 and the insert 45 to form a secure, strong, integrated structure of such components or portions thereof.

Each contact 25, particularly at its contacting portion 36, is relatively complaint to provide effective electrical connection with a lead of the integrated circuit package or other electrical device even though the actual lead positions may not be located exactly according to specification. Each contact 25 is intended to provide an electrical connection between a respective conductor 26 of the cable 21 and a respective lead of the integrated circuit package. The lead engaging contacting portion 36 of each contact 25 preferably is smoothly curved or bowed over the major extent thereof, as seen in FIG. 4, to facilitate smooth sliding, wiping and bending thereof with respect to a lead of the integrated circuit package as the clip connector is installed or removed with respect to such package. It also is noted that the cable 21 is secured in the clip bodies to extend generally parallel to a printed circuit board or the like on which the integrated circuit package may be mounted, thereby minimizing the space required for the cable and avoiding any need to bend or twist the cable in bringing it out from the clip connector and integrated circuit package.

Figure 5:
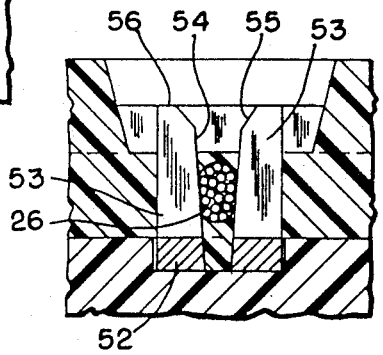
FIG. 5 is an enlarged partial sectional view taken substantially along the line 5—5 of FIG. 4.

As best seen in FIGS. 4 and 5, the mounting portion 47 of each contact 25 has a base portion 52 which extends in a direction generally parallel to the cable 21 and a coupling or terminal portion formed by a pair of elongate prong-like arms 53. The arms 53 are commonly joined to and extend perpendicularly from the base portion 52 to define therebetween a narrow slot 54. The arms 53 preferably are tapered or chamfered at their ends remote from the base portion 52 to define an entranceway 55 into the narrow slot 54 which has a width narrower than the normal diameter of the cable conductor 26 which may consist of a circular bundle of conductive strands. As the contact is joined with the cable by urging the two toward each other in the below described manner, the wide chamfered entranceway serves to guide the conductor 26 into the narrow slot 54. As the conductor enters the slot, it is somewhat flattened to provide a relatively enlarged surface area of engagement or connection with the two arms 53 as seen in FIG. 5. As seen in FIG. 4, the arms 53 may engage the conductor at a portion thereof from which the cable insulation 29 has been removed. It is noted, however, that the insulation need not be removed from the conductor at the area of engagement in which case the generally pointed tips 56 formed by the tapered ends of the arms will pierce through and displace insulation as the cable and contact are moved toward each other.

Figure 8:
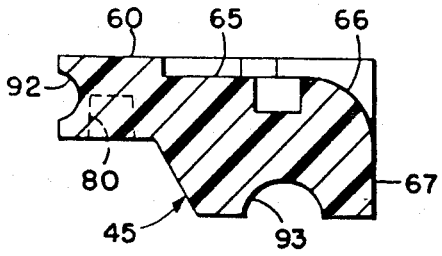
FIG. 8 is an enlarged sectional view through the insert taken substantially along the line 8—8 of FIG. 6.
Figure 7:
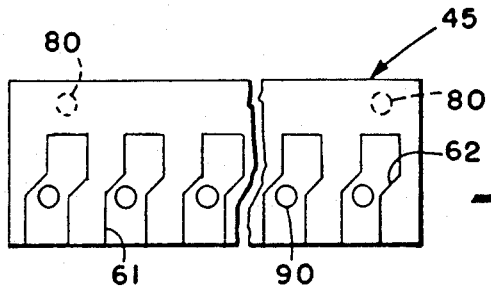
FIG. 7 is a fragmentary top plan view of the insert looking generally in the direction of the arrows 7—7 of FIG. 6.
Figure 6:
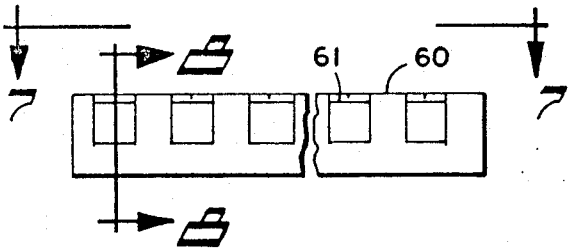
FIG. 6 is a fragmentary side elevational view of an insert used in the connector of FIG. 1.

In FIGS. 6–8, a preferred form of insert 45 is shown. The insert 45 has a generally planar top surface 60 provided with a plurality of laterally spaced apart recesses 61 configured to receive, locate and hold the base portions 52 of respective contacts 25. Each recess 61 is laterally staggered at 62 to correspond to the similarly staggered configuration of the respective contact base portion 52, the latter being illustrated by phantom lines in FIG. 3. Accordingly, the contacting portion 36 of each contact is laterally offset from its terminal portion formed by the arms 53.

The insert 45 molded into each clip body 22, 23. as below discussed preferably is identical to the insert molded into the other clip body but oppositely disposed with each insert having a length about and preferably equal the width of the cable 21 which is laterally centered in relation to the insert. Accordingly, the contacts 25 in each clip body which are generally longitudinally opposed to respective contacts in the other clip body have their contacting portions 36 offset from their respective terminal arm portions 53 in a direction opposite the offset of the contacting portions of contacts in the other clip body as shown in phantom lines in FIG. 3. Therefore, the contacting portions of each pair of opposed contacts such as those identified at **25*a* and 25*b* in FIG. 3, are in parallel opposed alignment with each other for engaging respective paired opposed leads on opposite sides of the integrated circuit package while the terminal arm portions of such paired opposed contacts are aligned with respective ones of relatively adjacent conductors of the cable. Thus, a conductor aligned for electrical connection with the terminal arm portion of the contact 25*a* will not be aligned with the terminal arm portion of the opposed contact 25*b* nor the terminal arm portion of a contact adjacent the contact 25*b***.

As seen in FIG. 8, the bottom surface of each recess 61 has a generally planar portion 65 extending parallel to the top surface 60 and a generally curved portion 66 which curves downwardly to a point of intersection with a vertical, generally planar inner side surface 67 of the insert 45. As seen in FIG. 4, the generally planar surface portion 65 serves to support the base portion 52 of the contact while the curved surface portion 66 accommodates and supports during flexing of the contact a relatively sharply and downwardly curved transition portion 68 of the contact. As further seen in FIG. 4, the planar inner side surface 67 forms a part of the bottom surface of the channel-like areas formed between the wall-like separators 35 which accommodate the connecting portions 36 of the contacts.

With respect to the method of the invention, the insert 45 primarily serves to support and locate the contacts 25 in proper relation to the cavity of a mold used to mold the balance forming portion 46 of the clip body 22. During closure of the mold the insert firmly supports the base portions 52 of the contacts against forces applied thereto during forced simultaneous joinder of the contact terminal arm portions 53 with respective conductors of the cable. After the mold is closed, the insert continues to support and locate the contacts, and also the cable 21 then connected to the contacts, in proper position in the cavity of the mold during molding of the balance forming portion 46 of the clip body thereabout. Thereafter, the insert forms an integral part of the clip body.

Figure 9:
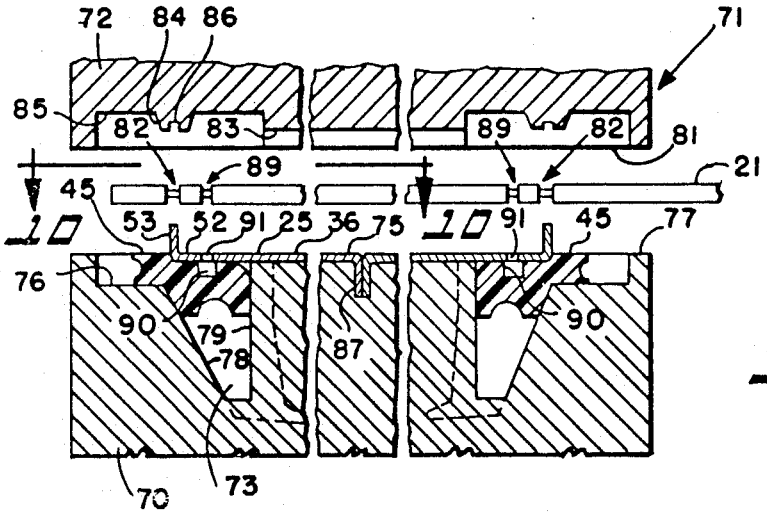
FIG. 9 is a fragmentary sectional view through a mold with components of the clip connector being shown positioned in the mold prior to closing of the mold.
Figure 10:
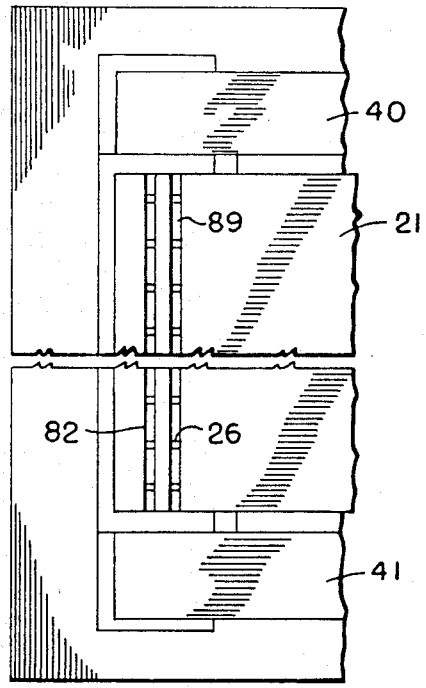
FIG. 10 is a plan view looking generally in the direction of the arrows 10—10 of FIG. 9.
Figure 11:
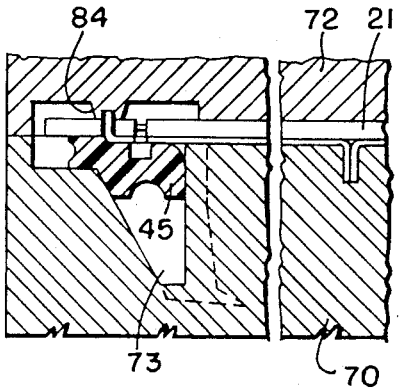
FIG. 11 is a partial sectional view through the mold when in its closed position just prior to molding of the balance forming portion of the clip bodies.

As seen in FIGS. 9 and 10, the insert 45 for each clip body may be placed in the lower part 70 of a two-piece mold 71. The mold 71 also includes an upper part 72 which, when the mold is closed as seen in FIG. 11, defines with the lower mold part a mold cavity 73 corresponding in shape to the respective clip body. That is, the upper and lower mold parts define respective mold cavities for the clip bodies 22 and 23 which cavities are spaced apart at the desired spacing of the clip bodies in the finished connector.

Respecting the herein illustrated embodiment of a clip connector according to the invention, the lower mold part 70 at each cavity 73 has a shelf surface 76 recessed from the parting face 77 thereof, a sloping surface 78 and generally vertical coplanar land surfaces 79 opposite the sloping surface 78. These surfaces 76, 78 and 79 engage corresponding surfaces of the insert 45 thereby to support firmly the insert against downward forces acting thereagainst during joinder of the contacts 25 with the conductors of the cable 21. As will be appreciated, the outer portion of the insert will be supported atop the shelf surface 76 against downward movement whereas the inner portion of the insert will engage or wedge between the sloping surface 78 and vertical land surfaces 79. To prevent lateral shifting of the insert relative to the lower mold part, the lower mold part may be provided with locating pins which project upwardly from the shelf surface 76 and into respective locating holes provided in the insert, such locating holes being indicated at 80 in FIGS. 7 and 8.

Before or after placement of the inserts 45 in the mold 71, the contacts 25 may be placed atop the inserts with the base portions of the contacts received in respective recesses 61. At this point in the manufacturing process, the contacting portions 36 of the contacts are coplanar with the base portions 52 while the terminal arms 53 project upwardly generally at right angles to the top surface 60 of the inserts. Also, as is preferred, the contacts for each body may remain joined to a respective carrier strip 75 provided during formation of the contacts by die cutting the same from a sheet of material. The carrier strip is bent downwardly to provide a handle 87 that facilitates positioning of the contacts in the mold. As seen in FIG. 9, the base portion 52 of each contact is supported by the insert while the contacting portion 36 extends in coplanar relation for support atop the lower mold part. Also, the bent-down handles 87 are received and located in a transverse slot in the lower mold part in butted engagement with one another.

After each insert 45 and the contacts 25 have been placed in the mold in the manner illustrated and described, the cable 21 may then be loaded into the mold between the lower and upper mold parts 70 and 72. As may be desirable, the cable may be received in a recess 83 provided in the parting face 81 of the upper mold part 72, such recess extending between the mold cavities and also from at least one mold cavity to the relatively adjacent end of the mold for allowing passage of the cable out of the mold. The recess 83 preferably has a width about equal and preferably slightly less than the width of the cable for facilitating proper positioning of the cable in the mold and further to provide a seal around the cable. As shown at 82, the cable may have insulation removed from the portions of conductors 26 intended to be joined with the terminal arm portions 53 of the contacts. Accordingly, the insulation is removed to form two laterally extending, narrow gaps 82 in the insulation which are parallel and longitudinally spaced apart such that each gap may be aligned with the row of terminal arm portions of the contacts located in a respective mold cavity when the cable is positioned in the mold. As is preferred, the longitudinal dimension of the gap is about equal the thickness of the terminal arms.

With the cable 21 properly positioned in the mold between the upper and lower mold parts 70 and 72, and also the leaf springs 40 and 41 as shown, the mold may then be closed as by lowering the upper mold part 72 into engagement with the lower mold part 70, which may be mounted stationary. As the upper mold part moves toward the lower mold part, the upper mold part will engage and urge the cable 21 downwardly over the terminal arms 53 of the contacts. For this purpose, the upper cavity part includes plural anvils 84 which are transversely spaced apart in relation to the cable at the same spacing as the cable conductors 26. The anvils 84 project downwardly into the mold cavity from the top cavity surface 85 of the upper mold part and are frustoconical in shape. During closure of the mold, the bottom surface of each anvil engages the top surface of the cable insulation 29 at each side of the insulation gap 82 and adjacent a respective conductor 26. In this manner the conductors at their exposed portions are simultaneously urged downwardly and between the terminal arms of respective contacts which are firmly held in proper position in the lower mold part by the insert. That is, the insert coacts with the lower mold part to support the terminal arms as the conductors are forceably inserted therebetween by the upper mold part. Each anvil is provided with a slot 86 extending transversely to the cable conductor for accommodating the upper end of the terminal arms when the mold is fully closed as seen in FIG. 11.

After the mold 71 is closed, molten plastic material is introduced as by injection into each mold cavity 73 to form the balance 46 of the respective clip body, the mold cavity being defined by the lower mold part and the upper mold part as above indicated. Preferably, the molten plastic material flows around the electrical junctions between the cable conductors 26 and the contact terminal arms 53 and around the exposed portions of the conductors to fill the gaps 82 in the cable insulation. As a result, the electrical junctions between the contacts and cable conductors will be encapsulated within the plastic material of the balance forming body portion 46 of the clip body as is best seen in FIG. 5. Of course, the balance forming body portion will also be molded about at least a portion of each of the cable, the inserts, the contacts and the leaf springs as above indicated. Also, during molding, each insert will hold the contacts and the cable then connected thereto in proper position in the respective mold cavity, it further being noted that the anvils 84 engaging the top surface of the cable insulation prevents upward displacement of the cable and contacts within the mold cavity.

As is preferrred, the cable 21 may have insulation removed to form therein gaps 89 each locatable in a respective mold cavity in alignment with holes 90 in the respective insert with which holes 91 in respective contacts are aligned. The holes 90 are formed in the bottom surfaces of respective recesses and are laterally aligned at best seen in FIG. 7. As the molten plastic material is injected into the mold cavities, such material will flow between the conductors at the gaps 89 in the insulation and through the holes 91 in the contacts into the aligned holes 90 in the insert to form, upon cure of the plastic material, a mechanical interlock between the cable, contacts and insert which provides a strong strain relief union therebetween. Each insert may also be provided, as best seen in FIG. 8, with semicircular grooves 92 and 93 respectively at its outer side and bottom side, the molten plastic material flowing into and filling such grooves further to interlock the insert within the balance forming body portion molded thereabout.

After such molding and removal of the clip connector from the mold, the handles 87 of the contact carrier strips 75 may be bent in a downward rotating fashion to bend the connecting portions 36 and transition portions 68 of the contacts generally to the shape illustrated in FIG. 4. The carriers may then be broken away from the contacts, preferably at scored break-away lines.

Further in accordance with the invention, it is contemplated that the contacts may be electrically and mechanically connected to the conductors of the cable generally in the above-described manner but outside of the mold as in a jig. According to this modified procedure, the thusly formed cable/contact subassembly may then be placed in the mold with the contacts being supported and located in proper position in the mold by respective inserts also loaded into the mold generally as shown in FIG. 9. The mold may then be closed and the balance forming body portion molded essentially in the aforedescribed manner. It is noted that in this modified procedure, the upper mold part need not be provided with the anvils 84 because of the prior interconnection of the contacts and cable conductors. However, it would be desirable to provide the upper mold part with one or more abutments projecting downwardly from the upper surface of the mold for engagement, when the mold is closed, with the top surface of the cable within the confines of the mold cavity to preclude upward displacement of the cable and contacts during the molding operation.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A method of manufacturing an electrical connector including an electrical cable having plural insulated electrical conductors, and at least one connector body including therein plural electrical contacts having contacting portions for engaging respective leads of an electrical device and coupling portions electrically connected to respective conductors of the cable, said method comprising the steps of:

(a) using a premolded insert of electrically non-conductive material placed within a cavity of a mold in supporting engagement with the mold to support the contacts in proper position in relation to such mold cavity, said using step including the step of placing the insert in supporting engagement with a first mold part which forms the mold cavity with a second mold part;

(b) positioning the cable between the second mold part and the coupling portions of the contacts supported on the insert;

(c) after said positioning step, relatively moving the first and second mold parts towards each other with the second mold part engaging the cable at its side opposite the contacts to effect forced pushing of the cable conductors into mechanical and electrical engagement with respective coupling portions of the contacts; and (d) after having closed the mold, flowing molten plastic material into the mold cavity to mold a balance forming part of the connector body about at least a part of each of the contacts, cable, and insert to form an integral structure with the insert forming a part of the connector body.

2. A method as set forth in claim 1, wherein each coupling portion includes a pair of terminal arms defining a conductor receiving slot therebetween, and said relatively moving step includes relatively moving the first and second mold parts towards each other with the second mold part engaging the cable at its side opposite the contacts to effect forced pushing of the cable into respective conductor receiving slots thereby to engage the cable conductors with respective contacts.

3. A method as set forth in claim 2, wherein the cable is of flat multi-conductor type, including the step of removing insulation of the cable from portions of the conductors, and wherein said cable positioning step includes aligning the insulation removed portions of the conductors with respective conductor receiving slots of the contacts.

4. A method as set forth in claim 2, wherein the cable is of flat-multi-conductor type, and said relatively moving step includes causing the terminal arms of the contacts to pierce through the insulation of the cable to permit passage of the cable conductors into the conductor receiving slots.

5. A method as set forth in claim 2, including the step of locating the contacts at portions thereof in respective recesses formed in the insert.

6. A method as set forth in claim 2, wherein the second mold part includes anvils projecting into the mold cavity to engage the cable at respective conductors adjacent the portions thereof being forced into the conductor receiving slots.

7. A method as set forth in claim 6, wherein each anvil includes a slot for receiving the terminal arms of the contacts.

8. A method as set forth in claim 1, wherein the electrical junctions are substantially encapsulated by the plastic material flowed into the mold.

9. A method as set forth in claim 1, including the step of aligning a gap in the insulation of the cable with openings in the contacts which in turn are aligned with holes in the insert, and flowing plastic material into such aligned gap, openings and holes to lock mechanically the cable and contacts in the connector body.

10. A method of manufacturing an electrical clip-like connector including an electrical cable having plural insulated conductors, a pair of connector bodies molded to respective longitudinally spaced apart portions of the cable and each including therein plural contacts having contacting portions for engaging respective leads of an electrical device and coupling portions electrically connected to respective conductors of the cable, and at least one resilient connecting member which connects the bodies for relative pivotal-like movement to permit clip-like attachment of the connector to the electrical device, comprising the steps of:

(a) simultaneously urging the coupling portions of the contacts for each body into mechanical and electrical engagement with respective conductors of the cable to form electrical junctions therebetween which are longitudinally spaced along the cable from the electrical junctions formed between conductors and the contacts for the other body;

(b) using a pair of premolded inserts of non-conductive material placed within respective body forming cavities of a mold in supporting engagement with the mold to support the contacts for respective bodies in proper position with respect to the body forming cavities;

(c) positioning the resilient connecting member in the mold with opposite ends thereof extending into respective body forming cavities; and (d) after closing the mold, flowing plastic material into each cavity to mold a balance forming part of the respective body about at least a part of each of the respective contacts, cable, insert and connecting member to form an integral structure with each insert forming a part of the respective connector body.

11. A method as set forth in claim 10, including the steps of placing the inserts in a first mold part which forms the mold cavities with a second mold part, positioning the cable between the second mold part and the coupling portions of the contacts supported on the inserts, each coupling portion including a pair of terminal arms defining a conductor receiving slot therebetween, and then relatively moving the first and second mold parts towards each other with the second mold part engaging the cable at its side opposite the contacts to effect forced pushing of the cable conductors into respective conductor receiving slots thereby simultaneously to engage the cable conductors with respective contacts.

12. A method as set forth in claim 11, wherein the cable is of flat multi-conductor type, including the step of removing the insulation of the cable from portions of the conductors and wherein said cable positioning step includes aligning the insulation removed portions of the conductors with respective conductor receiving slots of the contacts.

13. A method as set forth in claim 11, wherein the cable is of flat multi-conductor type, and said relatively moving step includes causing the terminal arms of the contacts to pierce through the insulation of the cable to permit passage of the cable conductors into the conductor receiving slots.

14. A method as set forth in claim 11, including the step of locating the contacts for each body at portions thereof in respective recesses formed in the respective insert.

15. A method as set forth in claim 11, wherein the second mold part includes anvil portions projecting into each mold cavity to engage the cable at respective conductors adjacent the portions thereof being forced into the slots.

16. A method as set forth in claim 15, wherein each anvil includes a slot for receiving the terminal arms of a respective contact.

17. A method as set forth in claim 10, wherein the electrical junctions are substantially encapsulated by the plastic material flowed into the mold.

18. A method as set forth in claim 10, including the step of aligning a gap in the insulation of the cable with openings in the contacts which in turn are aligned with holes in the respective insert, and flowing molten plastic material into such aligned gap, openings and holes to lock mechanically the cable and contacts in the connector body.

19. A method of manufacturing an electrical connector including an electrical cable having plural insulated electrical conductors, and at least one connector body including therein plural electrical contacts having contacting portions for engaging respective leads of an electrical device and coupling portions electrically connected to respective conductors of the cable, said method comprising the steps of:

(a) simultaneously urging the coupling portions of the contacts into mechanical and electrical engagement with respective conductors of the cable to form electrical junctions therebetween;

(b) using a premolded insert of electrically non-conductive material placed within a cavity of a mold in supporting engagement with the mold to support the contacts in proper position in relation to such mold cavity, and (c) after having closed the mold, flowing molten plastic material into the mold cavity to mold a balance forming part of the connector body about at least a part of each of the contacts, cable, and insert to form an integral structure with the insert forming a part of the connector body; and including the steps of:

(1) aligning a gap in the insulation of the cable with openings in the contacts which in turn are aligned with holes in the insert, and (2) flowing plastic material into such aligned gap, openings and holes to lock mechanically the cable and contacts in the connector body.

* * * * *

UNITED STATES PATENT AND TRADEMARK OFFICE

CERTIFICATE OF CORRECTION

PATENT NO. : 4,726,115

DATED : February 23, 1988

INVENTOR(S) : John Hartman

It is certified that error appears in the above-identified patent and that said Letters Patent is hereby corrected as shown below:

Column 6, line 41, "complaint" should read --compliant--; and column 9, line 50, "end" should read --ends--.

Signed and Sealed this

Thirteenth Day of June, 1989

*Attest:*

*Attesting Officer*

DONALD J. QUIGG

*Commissioner of Patents and Trademarks*